US005913715A

United States Patent [19]

Kirchner et al.

[11] Patent Number: 5,913,715

[45] Date of Patent: Jun. 22, 1999

[54] USE OF HYDROFLUORIC ACID FOR EFFECTIVE PAD CONDITIONING

[75] Inventors: Eric J. Kirchner, Weston, Mass.; Jayashree Kalpathy-Cramer, West Linn, Oreg.

[73] Assignee: LSI Logic Corporation, Milpitas, Calif.

[21] Appl. No.: 08/924,493

[22] Filed: Aug. 27, 1997

[51] Int. Cl.[6] ..... B24B 1/00

[52] U.S. Cl. ..... 451/56; 451/443; 451/444

[58] Field of Search ..... 451/56, 57, 287, 451/443, 41, 285, 288, 444, 60, 446, 21; 252/79.2, 79.4; 216/88, 89, 90

[56] References Cited

U.S. PATENT DOCUMENTS 5,081,051 1/1992 Mattingly et al. .
5,216,843 6/1993 Breivogel et al. .
5,245,794 9/1993 Salugsugan ..... 451/287
5,486,131 1/1996 Cesna et al. ..... 451/56
5,536,202 7/1996 Appel et al. .
5,547,417 8/1996 Breivogel et al. .
5,584,749 12/1996 Mitsuhashi et al. ..... 451/285
5,645,682 7/1997 Skrovan ..... 451/60
5,664,987 9/1997 Renteln ..... 451/287
5,709,593 1/1998 Guthrie et al. ..... 451/285
5,725,417 3/1998 Robinson ..... 451/56

*Primary Examiner*—David A. Scherbel
*Assistant Examiner*—Derrie Holt Banks

[57] ABSTRACT

A process of conditioning a polishing pad used in chemical mechanical polishing of an integrated circuit and having a glazed layer is described. The process includes introducing a conditioning reagent including at least one of hydrofluoric acid, buffered oxide etch composition and potassium hydroxide on the polishing pad to dissolve at least a portion of the glazed layer; and abrading the glazed layer and disloding at least some particles from the glazed layer.

20 Claims, 4 Drawing Sheets

USE OF HYDROFLUORIC ACID FOR EFFECTIVE PAD CONDITIONING

BACKGROUND OF THE INVENTION

The present invention relates to conditioning of a polishing pad employed in chemical-mechanical polishing (sometimes referred to as "CMP"). More particularly, the present invention relates to conditioning a polishing pad using a conditioning reagent that includes at least one of hydrofluoric acid, buffered oxide etch composition and potassium hydroxide.

Chemical mechanical polishing (CMP) typically involves mounting a wafer faced down on a holder and rotating the wafer face against a polishing pad mounted on a platen, which in turn is rotating or is in an orbital state. A slurry containing a chemical that chemically interacts with the facing wafer layer and an abrasive that physically removes that layer is flowed between the wafer and the polishing pad or on the pad near the wafer. In semiconductor wafer fabrication, this technique is commonly applied to polish various wafer layers such as dielectric layers, metallization, etc.

Unfortunately after polishing on the same polishing pad for over a period of time, the polishing pad suffers from "pad glazing." As is well known in the art, pad glazing results when the particles eroded from the wafer surface along with the abrasives in the slurry tend to glaze or accumulate over the polishing pad. A glazed layer on the polished pad typically forms from eroded film and slurry particles that are embedded in the porosity or fibers of the polishing pad. Pad glazing is particularly pronounced during planarization of an oxide layer such as silicon dioxide layer (hereinafter referred to as "oxide CMP"). By way of example, during oxide CMP, eroded silicon dioxide particulate residue accumulates along with the abrasive particles from the slurry to form a glaze on the polishing pad. Pad glazing is undesirable because it reduces the polishing rate of the wafer surface and produces a non-uniformly polished wafer surface. The non-uniformity results because glazed layers are often unevenly distributed over a polishing pad surface.

One way of achieving and maintaining a high and stable polishing rate is by conditioning the polishing pad (hereinafter referred to as "pad conditioning") on a regular basis, i.e. either every time after a wafer has been polished or simultaneously during wafer CMP. FIG. 1 shows a side-sectional view of a cross-section of a polishing pad 102 undergoing conditioning according to conventional methods of pad conditioning. A surface of polishing pad 102 that is employed for oxide CMP has deposited on it a glazed oxide layer 104 resulting from pad glazing described above. During pad conditioning, a stream of water 106 is introduced over the polishing pad and a particle 108, for example, is dislodged from glazed layer 104 by mechanical action, described below in detail, to produce dislodged particles 108'. Furthermore, loose oxide particles 110 may also be found on the surface of polishing pad 104 as eroded oxide or slurry residue from CMP.

During pad conditioning, a conditioning arm or an abrasive disk (both not shown to simplify illustration) having an abrasive portion contact polishing pad 102, which may be rotating or in an orbital state. A pneumatic cylinder (not shown to simplify illustration) may then apply a downward force on the conditioning arm or abrasive disk such that the abrasive portion contacts and engages with a substantial portion of polishing pad 102. During pad conditioning, the conditioning arm typically sweeps back and forth across polishing pad 102 like a "windshield wiper blade" from one end of the polishing pad to another. In the case where pad conditioning is facilitated by the abrasive disk, the abrasive disk typically moves in a radial direction and out of an inner point and an outer point of polishing pad 102. By this mechanical action of the conditioning arm or abrasive disk, the abrasive portions attempt to break up and remove the glazed or accumulated particles coated on the polishing pad surface.

Unfortunately, the mechanical action of conventional pad conditioning processes are ineffective to completely remove the glazed layer. The sweeping action of the conditioning arm or the radial movement of the abrasive disk across the polishing pad distributes the mechanical action of the abrasive portions almost uniformly throughout the polishing pad surface. Such mechanical action is not forceful enough to remove the glazed layer from those regions of the polishing pad where the glazed layer is thicker and/or compacted to a greater extent than that on other regions of the polishing pad. The problems of lower material removal rate and nonuniform polishing, therefore, still persist albeit to a lesser degree. Furthermore, the unremoved portions of the glazed layer prevent the formation of grooves on the polishing pad during pad conditioning. As is well known to those skilled in the art, polishing pad grooves facilitate the polishing process by creating point contacts between the wafer surface and the pad, increase the pad roughness and between the wafer surface allow more slurry to be applied to the substrate per unit area. Thus, due to the presence of the glazed layer and absence of grooves on the polishing pad, a polishing pad conditioned by conventional pad conditioning methods suffers from lower material removal rates and non-uniform polishing of the wafer surface. Furthermore, inadequate pad conditioning also shortens the life of the polishing pad. In a typical wafer fabrication facility, where several CMP apparatus are employed, the replacement cost of polishing pads can be significant.

What is therefore needed is an improved apparatus and process for pad conditioning that provides higher material removal rates, uniform polishing of the wafer surface and longer pad life.

SUMMARY OF THE INVENTION

To achieve the foregoing, the present invention provides a process of conditioning a polishing pad used in chemical mechanical polishing of an integrated circuit and having a glazed layer. The process includes introducing a conditioning reagent including at least one of hydrofluoric acid, buffered oxide etch (BOE) composition and potassium hydroxide on the polishing pad to dissolve at least a portion of the glazed layer and abrading the glazed layer and dislodging at least some particles from the glazed layer.

The pad conditioning process of the present invention may further include flushing the polishing pad with sufficient amounts of deionized water to substantially remove the conditioning reagent including hydrofluoric acid. The pad conditioning process may further still include introducing slurry on the polishing pad to commence chemical-mechanical polishing. The conditioning reagent in the step of introducing the conditioning reagent may include deionized water. The concentration of hydrofluoric acid in the conditioning reagent may be between about 0.1% by volume and about 2% by volume. The conditioning process may generally be carried out for a period of time that is between about 20 seconds and about 1 minute and preferably carried out for a period of time that is about 30 seconds.

The step of abrading may be performed by engaging the polishing pad with a conditioning arm having an abrasive portion. The step of introducing the conditioning reagent may include dispensing the conditioning reagent through at least one opening in the conditioning arm. The step of abrading may be performed by engaging the polishing pad with an abrasive disk. The glazed layer may include silicon dioxide particles and slurry residue. The step of introducing the conditioning reagent and abrading may be carried out simultaneously. The step of introducing the conditioning reagent may include providing the conditioning reagent on the polishing pad in a flow rate that is generally between about 50 and about 500 ml/minute for the duration of the conditioning process and preferably about 150 ml/min for the duration of the conditioning process. The conditioning process may be carried out after the integrated circuit has been subjected to chemical-mechanical polishing. The polishing pad may be made from at least one of urethane, polyurethane, felt polymer and a filler material.

In another aspect, the present invention provides in a pad conditioning sub-assembly, a conditioning reagent for conditioning a polishing pad used in chemical-mechanical polishing of an integrated circuit. The conditioning reagent includes an effective amount of hydrofluoric acid to dissolve at least a portion of the glazed layer and an effective amount of deionized water to dissolve at least some of hydrofluoric acid.

The effective amount of hydrofluoric acid may generally between about 0.1% by volume and about 2% by volume and preferably be between about 0.1% by volume and about 1% by volume. The effective amount of deionized water is between about 99% by volume and about 99.9% by volume.

In yet another aspect, the present invention provides a pad conditioning sub-assembly integrated into a chemical-mechanical polishing apparatus for polishing an integrated circuit. The pad conditioning sub-assembly includes a polishing pad having a glazed layer, means for introducing a conditioning reagent including hydrofluoric acid on the polishing pad, the conditioning reagent includes hydrofluoric acid in effective amounts to dissolve at least a portion of the glazed layer, a reservoir of the conditioning reagent including hydrofluoric acid and the reservoir is in communication with the means for introducing, and an abrasive portion for mechanically abrading at least a portion of glazed layer on the polishing pad.

The abrasive portion may be a component of a conditioning arm or an abrasive disk. The means for introducing may include a plurality of holes in a manifold attached to the conditioning arm. The means for introducing may include an inlet designed for introducing slurry employed during the chemical-mechanical process and the inlet is in communication with the reservoir of the conditioning reagent including hydrofluoric acid.

DETAILED DESCRIPTION OF THE PREFERRED EMBODIMENTS

The present invention provides a pad conditioning process using a conditioning reagent that includes at least one of hydrofluoric acid (HF), buffered oxide etch (BOE) composition and potassium hydroxide. In the following description, numerous specific details are set forth in order to fully illustrate a preferred embodiment of the present invention. By way of example, the present invention is described in terms of a preferred embodiment of the conditioning reagent, which embodiment includes hydrofluoric acid (HF). It should be noted, however, that the conditioning reagent may similarly include buffered oxide etch (BOE) composition and/or potassium hydroxide. The concentration of buffered oxide etch (BOE) in the conditioning reagent may be substantially similar to the concentration of HF in the conditioning reagent described below. Furthermore, potassium hydroxide may be present in the conditioning reagent insufficient amounts so that the pH of the conditioning reagent ranges from between about 11.5 to about 12.

The present invention effectively combines a chemical attack of a conditioning reagent with a mechanical action of a conventional pad conditioning apparatus to effectively condition a polishing pad. The conditioning reagent in the present invention includes at least one of hydrofluoric acid (HF), buffered oxide etch (BOE) composition and potassium hydroxide in amounts effective to dissolve at least a portion of the glazed layer. The mechanical action, according to one embodiment of the present invention, may be facilitated by conventional conditioning tools, such as a conditioning arm or an abrasive disk, for example. As mentioned above, the conditioning arm or abrasive disk typically has an abrasive portion that engages the polishing pad during conditioning and abrades the glazed layer to dislodge at least some particles from it. By more uniform and complete removal of the glazed layer, pad conditioning according to the present invention provides a higher polishing rate for the integrated circuit CMP and a more uniformly polished integrated circuit surface.

Figure 2A:
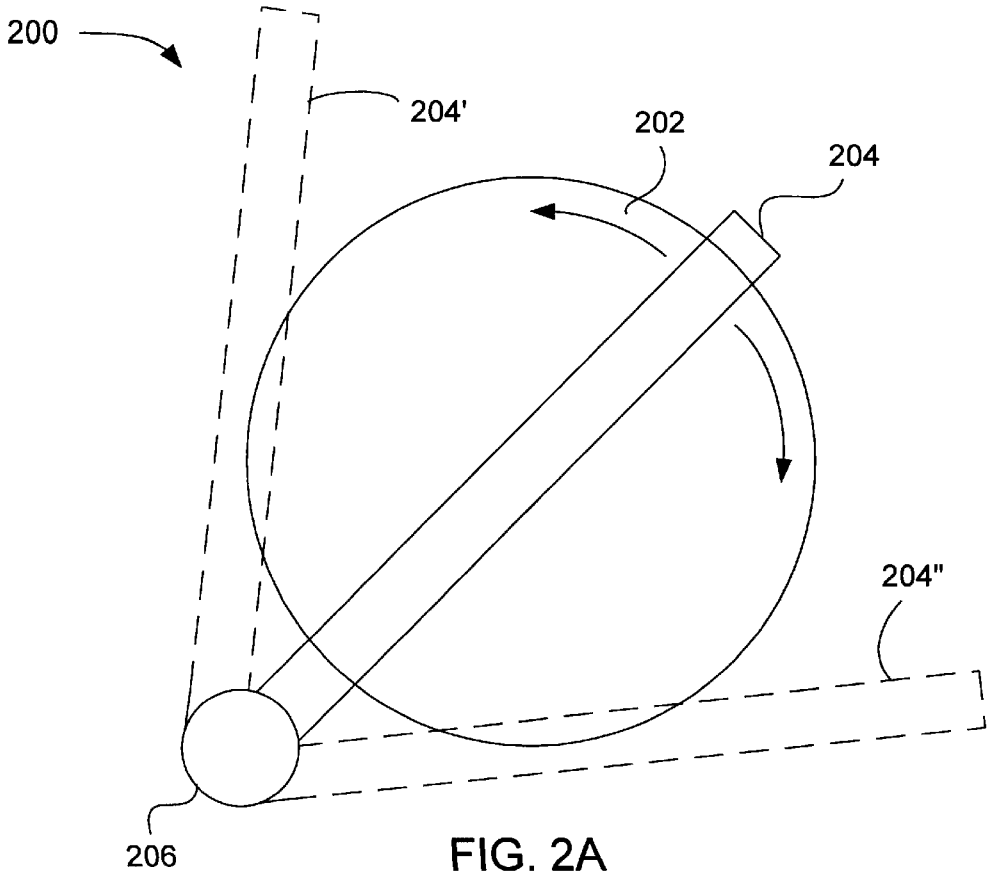
FIG. 2A shows a top view of a conditioning sub-assembly for conditioning a polishing pad.

The pad conditioning process, according to one embodiment of the present invention, may be carried out by a conditioning sub-assembly that is integrated into a conventional CMP apparatus. By way of example, FIG. 2A shows some significant components of a conditioning sub-assembly 200 that is integrated into CMP such as the AvantGaard 676, commercially available from Integrated Processing Equipment Corporation (IPEC) of Phoenix, Ariz. Conditioning sub-assembly 200 includes a conditioning arm 204 that is disposed above a polishing pad 202 and capable of pivoting about a pivoting point 206. Conditioning arm 204, as shown in FIG. 2A, is typically longer in length than the diameter of polishing pad 202.

Figure 2B:
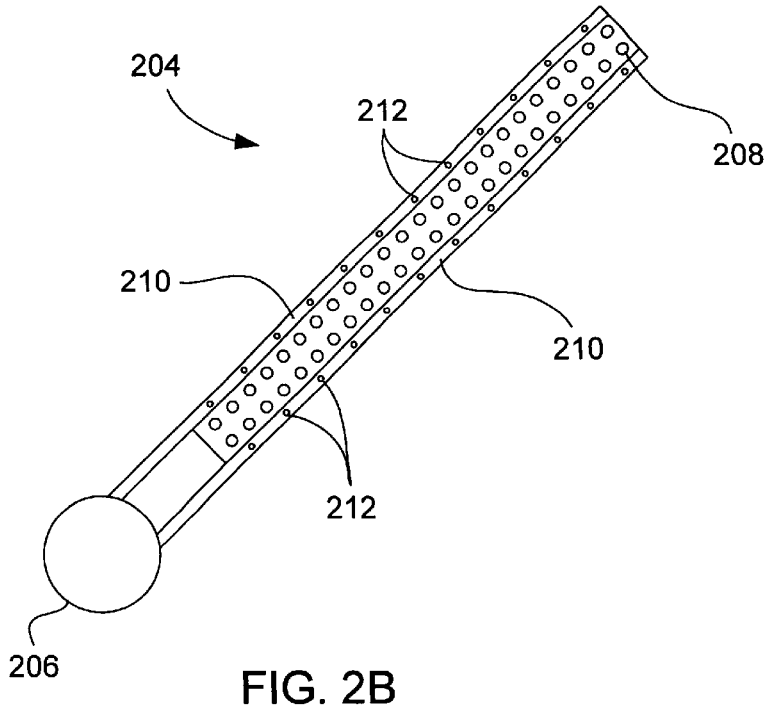
FIG. 2B shows a bottom view of the conditioning arm of the conditioning sub-assembly of FIG. 2A.

FIG. 2B shows a bottom view of conditioning arm 204 of FIG. 2A. The bottom surface of conditioning arm 204 includes a plurality of diamond abrasive particles 208, which are almost uniformly arranged on conditioning 204 arm such that if the conditioning arm contacts polishing pad 202, abrasive particles 208 engage with a substantial portion of the polishing pad. A manifold 210 having a plurality of openings 212 is mounted on both sides of conditioning arm 204, as shown in FIG. 2B. Openings 212 are designed to dispense conditioning reagent including HF on polishing pad 202 during pad conditioning and are therefore in communication with a reservoir of conditioning reagent (not shown to simplify illustration). In this configuration, openings 212 along with manifold 210 span the entire length of conditioning arm 204.

Before a pad conditioning process 300, according to one embodiment of the present invention, begins, a conditioning arm or an abrasive disk is lowered automatically to contact a polishing pad, which may be rotating or in an orbital state. At this point, polishing of an integrated circuit substrate may have concluded or an integrated circuit may be undergoing chemical-mechanical polishing. Pad conditioning process 300 begins in a step 302, which includes introducing a conditioning reagent including HF on the polishing pad. By way of example, in FIG. 2A, the conditioning reagent may be introduced on polishing pad 202 through openings 212, which are in communication with a reservoir of conditioning reagent. In step 302, the conditioning reagent is pumped from the conditioning reagent reservoir, through manifold 210 and dispensed out of openings 212 on polishing pad 202.

As a further example, in a conditioning sub-assembly that employs an abrasive disk and is integrated into a chemical-mechanical polishing apparatus such as the Avanti 472, also commercially available from Integrated Processing Equipment Corporation (IPEC) of Phoenix, Ariz., the conditioning reagent is delivered to the polishing pad via the same outlet that is used to provide slurry to the polishing pad during chemical-mechanical polishing. In this example, the "slurry outlet" is in communication with both the slurry and conditioning reagent reservoirs and disposed above the polishing pad. By activating the appropriate fluid flow equipment, such as pump(s), valve(s), etc., well known to those skilled in the art, the conditioning reagent is supplied on the polishing pad through the slurry outlet.

The conditioning reagent of the present invention may include HF admixed with at least one of slurry or deionized water. The slurry may be the same slurry that is employed during chemical-mechanical polishing. While not intending to be bound by theory, the HF in the conditioning reagent reacts primarily with the abundant silicon dioxide ($SiO_2$) particles in the glazed layer to produce silicon fluoride ($SiF_4$) and water. During conditioning, the presence of HF in the conditioning reagent, therefore, effectively dissolves at least a portion of the glazed layer. Those skilled in the art will recognize that HF may be present in the conditioning reagent in sufficiently dilute amounts to effectively dissolve and facilitate the removal of at least a portion of the glazed layer, without unduly damaging the polishing pad and the equipment employed during pad conditioning. The final concentration of HF in the conditioning reagent may generally be between about 0.1% by volume and about 2% by volume and preferably be between about 0.1% by volume and about 1% by volume.

It is also important to provide sufficient amounts of the conditioning reagent including HF to wage a substantially uniform chemical attack on the glazed layer throughout the polishing pad. By way of example, for a polishing pad diameter of about 10 inches in the AvantGaard 676 or a polishing pad diameter of about 22 inches in the Avanti 472, a flow rate of conditioning reagent including HF on the polishing pad is generally between about 50 and about 500 ml/min (milliliters/minute) for the duration of pad conditioning process 300 and preferably about 150 ml/min for the duration of pad conditioning. Of course, for larger or smaller polishing pad diameters or for longer or shorter duration of pad conditioning process, the flow rate of the conditioning reagent will have to be adjusted accordingly.

Figure 1:
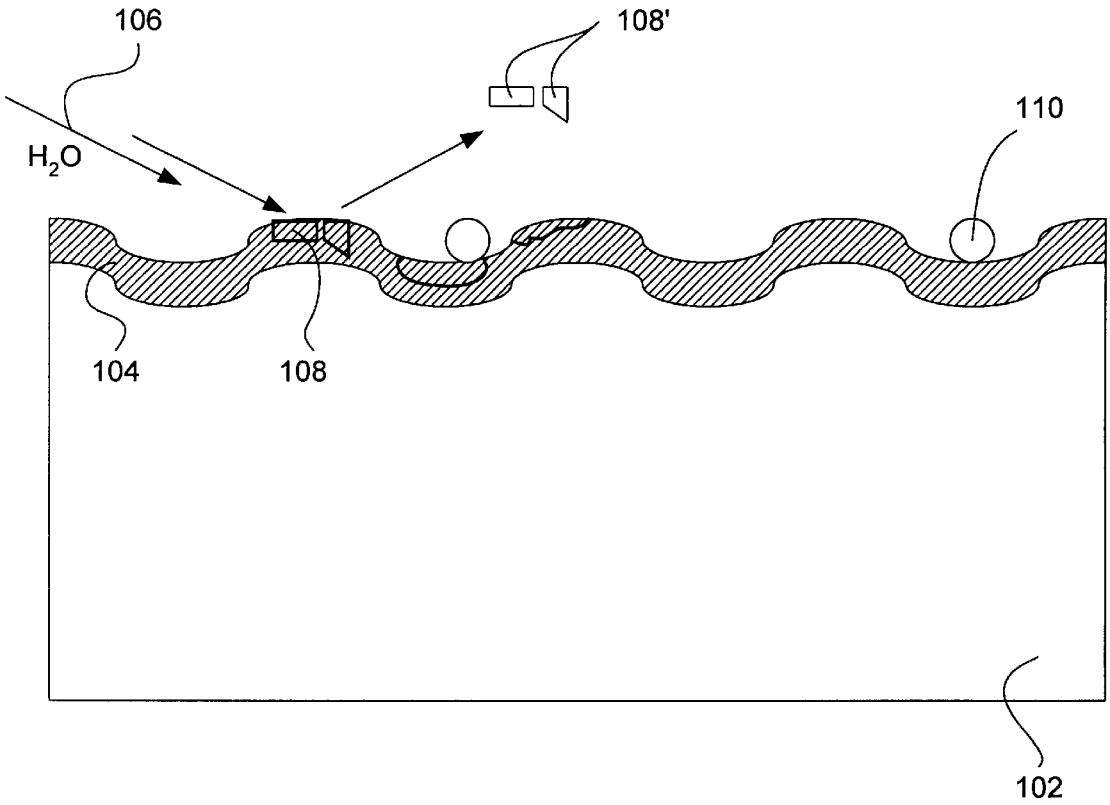
FIG. 1 shows a side-sectional view of a polishing pad undergoing conditioning according to conventional pad conditioning methods.

A step 304 includes abrading by mechanical action at least a portion of the glazed layer, e.g., glazed layer 104 of FIG. 1, on the polishing pad. By way of example, in the AvantGaard 676, this may be accomplished by conditioning arm 204 shown in FIG. 2A. A pneumatic cylinder applies a downward force on conditioning arm 204 such that abrasive particles 208 contact and engage a substantial portion of polishing pad 202. During pad conditioning, conditioning arm 204 pivots on pivoting end 206 and sweeps back and forth across polishing pad 202 like a "windshield wiper blade" from a first position 204' (shown by dashed lines) at one end of the polishing pad to a second position 204" (shown by dashed lines) at the other end of the polishing pad.

As a further example, in the Avanti 472, this may be accomplished by the abrasive disk, which applies a downward force on the polishing pad during step 304 such that an abrasive portion of the abrasive disk engages with the polishing pad and moves in and out of an inner radius and an outer radius of the polishing pad. By this mechanical action of the conditioning arm or abrasive disk, the abrasive portions abrade and dislodge particles from the glazed layer on the polishing pad surface.

Steps 302 and 304 can be carried out in any order, e.g., step 302 may be carried out after step 304, or repeated numerous times in any order. In one preferred embodiment, however, steps 302 and 304 of the present invention may be carried out simultaneously, i.e. the conditioning reagent and the mechanical action of an abrasive portion attack the glazed layer on the polishing pad at the same time. By way of example, in this embodiment, as conditioning arm 204 in the AvantGaard 676 sweeps back and forth across polishing pad 202 like a windshield wiper, as shown in FIG. 2A, the conditioning reagent including HF is dispensed from openings 212 at the same time. Those skilled in the art will recognize that because openings 212 span the entire length of the conditioning arm, the conditioning reagent is delivered substantially uniformly throughout the polishing pad as the conditioning arm sweeps back and forth across the polishing pad. Thus, in this embodiment, the combination of the mechanical action of the conditioning arm with the chemical attack of the conditioning reagent dissolves and abrades at a least portion of the glazed layer at the same time.

After a significant amount of the glazed layer has been removed, pad conditioning process 300 may maintain at least the mechanical action of the abrasive portion of the conditioning arm or abrasive disk described in step 304 to facilitate the formation of grooves, microgrooves or perforations on the polishing pad. Although the polishing pad in the AvantGaard 676, for example, is designed to have grooves, microgrooves or perforations for slurry distribution and improved pad-wafer contact, the effectiveness of such grooves or microgrooves is reduced over time due to normal polishing. In addition to removing at least a substantial portion of the glazed layer, pad conditioning process 300 also reintroduces grooves and/or microgrooves or roughens the pad surface.

Grooves and/or microgrooves produced during pad conditioning facilitate the polishing process by creating point contacts between the wafer surface and the pad, increase the pad roughness and allow more slurry to be applied to the substrate per unit area. Accordingly, the grooves generated on a polishing pad during pad conditioning increase and stabilize the wafer polishing rate. Pad condition process 300 is, therefore, generally carried out for a long enough duration to ensure the removal of at least a substantial portion of the glazed layer and formation of grooves on the polishing pad. Preferably, for a pad rotation rate that is between about 30 and about 100 cycles/minute, a downward force of about 4 pounds (lbs), pad conditioning process 300 of the present invention may be carried out for a period of time that is between about 20 seconds and about 1 minute and more preferably the period of time is about 30 seconds. Of course those skilled in the art will recognize that for lower or higher pad rotation rate and downward force, the time of pad conditioning will vary.

After pad condition process 300 has concluded, in one preferred embodiment, the polishing pad of the present invention may be flushed with large quantities of water to ensure that at least a substantial amount of the conditioning reagent including HF is removed from the polishing pad. Thereafter, slurry may be introduced on the polishing pad and chemical-mechanical polishing pad of an integrated circuit may proceed normally.

Figure 3:
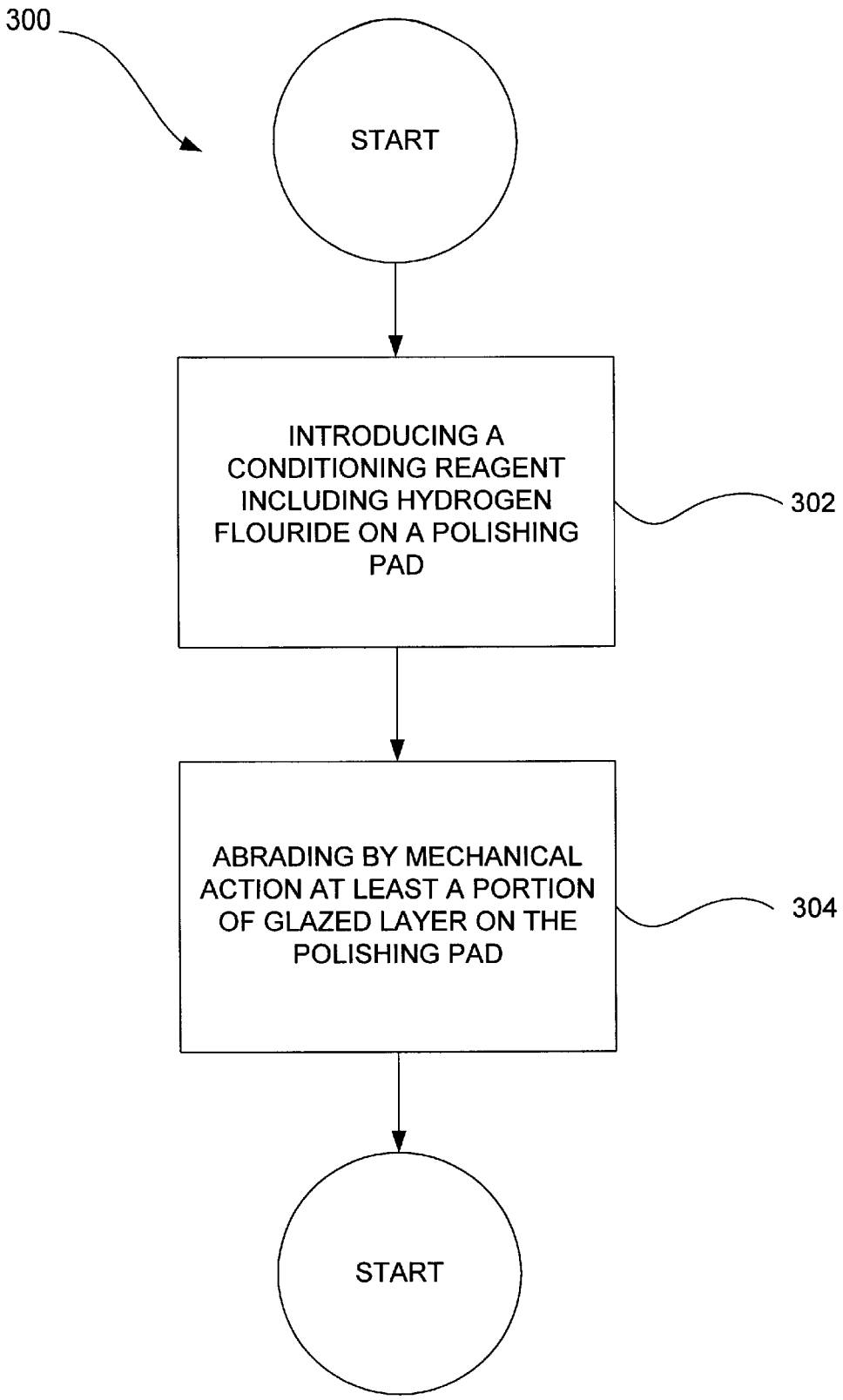
FIG. 3 is a flowchart of a pad conditioning process, according to one embodiment of the present invention.
Figure 4:
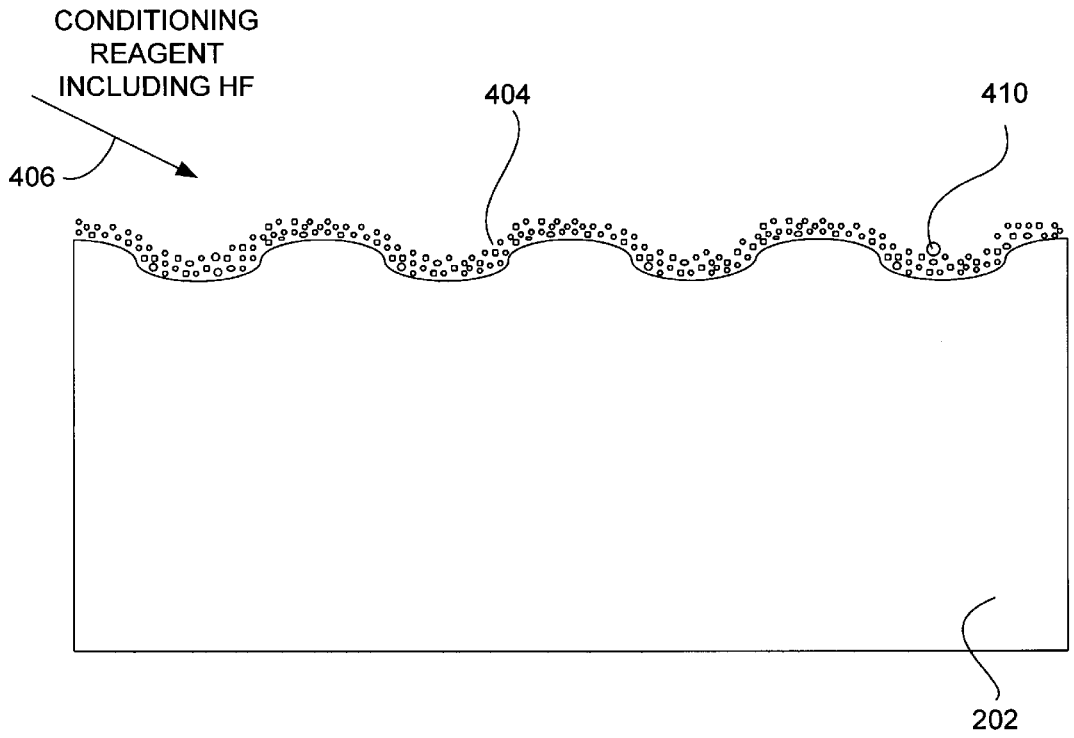
FIG. 4 shows a side-sectional view of a polishing pad undergoing conditioning according to one embodiment of the present invention.

FIG. 4 shows a polishing pad 202 undergoing conditioning, according to one embodiment of pad conditioning process 300 as shown in FIG. 3 of the present invention. A substantially disintegrated glazed layer 404 resulting from this pad conditioning process is disposed above polishing pad 202. Disintegrated glazed layer 404 includes a combination of dissolved and abraded particles from the glazed layer in a liquid medium. Loose particles 410, which were never part of the glazed layer from the eroded oxide layer and slurry residue are also disposed above polishing pad 202. Those skilled in the art will recognize that during pad conditioning process 300 of FIG. 3, at least some of the abraded particles and loose particles 410 dissolve in the conditioning reagent including HF. The composition of disintegrated layer 404 and loose particles 410 may reflect the composition of the oxide and slurry residue along with silicon fluoride ($SiF_4$) and wafer. Preferably, polishing pad 202 is made from at least one of urethane, polyurethane, felt, polymer and a filler material well known to those skilled in the art.

The present invention represents a marked improvement over the conventional pad conditioning processes. By way of example, the pad conditioning process of the present invention, by combining a mechanical action with a chemical attack, is capable of effectively removing all or at least a substantial portion of the glazed layer and forming grooves or perforations on the polishing pad. This translates into increased material removal rates for the CMP process and produces a more uniformly polished wafer surface. Pad conditioning according to the present invention also prolongs the life of the polishing pad considerably and lowers the replacement cost of polishing pads in a integrated circuit fabrication facility. As another example, the present invention provides such advantages by utilizing the existing conditioning sub-assemblies that are integrated into CMP apparatuses currently employed.

Although the foregoing invention has been described in some detail for purposes of clarity of understanding, it will be apparent that certain changes and modifications may be practiced within the scope of the appended claims. For example, while the specification has described the pad conditioning processes and apparatuses to be used in the context of chemical-mechanical polishing, there is no reason why in principle such pad conditioning processes and apparatuses could not be used to condition a polishing pad used in other polishing applications. Therefore, the present embodiments are to be considered as illustrative and not restrictive, and the invention is not to be limited to the details given herein, but may be modified within the scope of the appended claims.

What is claimed is:

1. A process of conditioning a polishing pad used in chemical mechanical polishing of an integrated circuit and having a glazed layer, said process comprising:

introducing a conditioning reagent including at least one of hydrofluoric acid, buffered oxide etch composition and potassium hydroxide on said polishing pad to dissolve at least a portion of said glazed layer, said potassium hydroxide in sufficient amounts such that a pH of said conditioning reagent is between about 11.5 and about 1 2; and abrading said glazed layer and dislodging at least some particles from said glazed layer.

2. The process of claim 1, further comprising flushing said polishing pad with sufficient amounts of deionized water to substantially remove the conditioning reagent.

3. The process of claim 2, further comprising introducing slurry on the polishing pad to commence chemical-mechanical polishing.

4. The process of claim 1, wherein the conditioning reagent in said step of introducing the conditioning reagent includes deionized water.

5. The process of claim 1, wherein a concentration of hydrofluoric acid in the conditioning reagent is between about 0.1% by volume and about 2% by volume.

6. The process of claim 1, the conditioning process is carried out for a period of time that is between about 20 seconds and about 1 minute.

7. The process of claim 6, wherein the conditioning process is carried out for a period of time that is between about 30 seconds.

8. The process of claim 1, wherein said abrading is performed by engaging said polishing pad with a conditioning arm having an abrasive portion.

9. The process of claim 8, wherein said introducing the conditioning reagent includes dispensing the conditioning reagent through at least one opening in the conditioning arm.

10. The process of claim 1, wherein said abrading is performed by engaging said polishing pad with an abrasive disk.

11. The process of claim 1, wherein said glazed layer includes silicon dioxide particles and slurry residue.

12. The process of claim 1, wherein said introducing the conditioning reagent and abrading are carried out simultaneously.

13. The process of claim 1, wherein said introducing the conditioning reagent includes providing the conditioning reagent on the polishing pad in a flow rate that is between about 50 and about 500 ml/minute for the duration of the conditioning process.

14. The process of claim 1, wherein said conditioning process is carried out after said integrated circuit has been subjected to chemical-mechanical polishing.

15. The process of claim 1, wherein said polishing pad is made from at least one of urethane, polyurethane, felt polymer and a filler material.

16. In a pad conditioning sub-assembly, a conditioning reagent for conditioning a polishing pad used in chemical-mechanical polishing of an integrated circuit, said conditioning reagent comprising:

an effective amount of at least one of hydrofluoric acid, buffered oxide etch composition and potassium hydroxide to dissolve at least a portion of said glazed layer, said potassium hydroxide in sufficient amounts such that a pH of said conditioning reagent is between about 11.5 and about 12; and an effective amount of deionized water to dissolve at least some of the hydrofluoric acid, buffered oxide etch composition or potassium hydroxide.

17. The pad conditioning sub-assembly of claim 16, wherein the effective amount of hydrofluoric acid is between about 0.1% by volume and about 2% by volume.

18. The pad conditioning sub-assembly of claim 17, wherein the effective amount of hydrofluoric acid is between about 0.1% by volume and about 1% by volume.

19. The pad conditioning sub-assembly of claim 16, wherein the effective amount of deionized water is between about 99% by volume and about 99.9% by volume.

20. The pad conditioning sub-assembly of claim 16, wherein the effective amount of buffered oxide etch composition is between about 0.1% by volume and about 2% by volume.

* * * * *